US005564860A

United States Patent [19]

Amann

[11] Patent Number: 5,564,860

[45] Date of Patent: Oct. 15, 1996

[54] FIXTURE FOR ATTACHING A GRATE TO A DRAINAGE CHANNEL

[75] Inventor: Max Amann, Adliswil, Switzerland

[73] Assignee: ABT, Inc., Troutman, N.C.

[21] Appl. No.: 408,583

[22] Filed: Mar. 22, 1995

[30] Foreign Application Priority Data

Mar. 22, 1994 [CH] Switzerland ..... 850/94

[51] Int. Cl.[6] ..... E02B 5/08; F16B 21/00

[52] U.S. Cl. ..... 405/118; 404/2; 411/349; 411/549; 411/553

[58] Field of Search ..... 405/118, 119, 405/120, 121; 404/4, 2; 411/553, 549, 349, 535, 536

[56] References Cited

U.S. PATENT DOCUMENTS

| | | | |
|---|---|---|---|
| Re. 33,439 | 11/1990 | Thomann et al. | 404/4 X |
| 2,406,007 | 10/1943 | Eisele | 411/549 |
| 2,492,114 | 11/1944 | Crowther | 411/549 |
| 2,714,754 | 5/1952 | Knohl | 411/553 |
| 3,407,454 | 10/1968 | Myatt | 411/549 |

FOREIGN PATENT DOCUMENTS

112287B1 8/1985 European Pat. Off. .

*Primary Examiner*—Tamara L. Graysay
*Assistant Examiner*—Tara L. Mayo
*Attorney, Agent, or Firm*—Bell, Seltzer, Park & Gibson, P.A.

[57] ABSTRACT

A grate attachment fixture is disclosed which rotationally engages a locking bar with the opposed sidewalls of a drainage channel and which thereafter secures a grate to the drainage channel. The grate attachment fixture includes a rotatable connector adapted to adjustably interconnect the locking bar and the grate. The grate attachment fixture also includes a grate securing member affixed to the locking bar. The grate securing member includes a pair of adjustment surfaces including a positive engagement surface for engaging a portion of the connector such that upon rotation of the connector in a first angular direction, the locking bar initially rotates within the trench in the first angular direction until the first locking bar engages the opposed sidewalls. Thereafter, the positive engagement surface cooperates with the connector to apply a tensile force between the grate and the locking bar upon further rotation of the connector. The adjustment surfaces also include a latching surface, adjoining the positive engagement surface, adapted to maintain the connector in a tensioned state between the grate and the locking bar. Thus, the grate will remain securely attached to the drainage channel during use in which a variety of forces and loads are applied thereto.

20 Claims, 2 Drawing Sheets

FIXTURE FOR ATTACHING A GRATE TO A DRAINAGE CHANNEL

FIELD OF THE INVENTION

The present invention relates generally to drainage systems and, more particularly, to a drainage channel having a grate covering its open top.

BACKGROUND OF THE INVENTION

Drainage and other trenches are employed in a variety of applications to collect and drain water and other fluids from roadways, runways, parking lots or other surfaces. As known to those skilled in the art, a trench can be formed by a drainage channel which generally includes a longitudinally extending bottom wall and first and second longitudinally extending sidewalls which extend upwardly from opposed edges of the bottom wall to thereby define the upwardly opening longitudinal trench. In order to prevent objects from becoming lodged in the trench which may block or otherwise impede the fluid drainage and to prevent people from inadvertently stepping into the trench, drainage channels also generally include a grate covering the open top of the trench and extending between upper portions of the opposed sidewalls.

Once installed, a variety of forces and loads are applied to the drainage channel and, more particularly, to the grate. For example, passing vehicles can roll across the grate, thereby subjecting the drainage channel to the repeated application of a variety of compressive forces. In order to stabilize the grate and to prevent the grate from rocking or from becoming displaced when weight, such as a passing vehicle, is applied thereto, various methods have been developed to attach or secure the grate to the drainage channel.

For example, European Patent No. 112 287 discloses a fixture for bolting a grate to a drainage channel. As described, the opposed sidewalls of the drainage channel each define a respective indention. The indentions are adapted to engage a locking bar which, in turn, is connected to the grate via a threaded bolt. By turning the bolt in a generally clockwise manner, the associated locking bar can be threadably advanced until the bar reaches a stop defined by the indention. By this process, the bar is fastened and braced against the stop, thereby attaching the grate to the drainage channel.

While this method of attaching a grate to a drainage channel is generally reliable, each fixture requires precise alignment of the grate attaching fixture with the indentions defined by the opposed sidewalls. The alignment step is further complicated because the grate extends laterally between upper portions of the opposed sidewalls of the channel, with the result that the interior of the drainage channel is relatively inaccessible once the grate has been placed across the trench. Due, at least in part to this inaccessibility, the alignment and installation of each fixture can be relatively laborious and time consuming. Thus, the process of securing a grate to a relatively long drainage channel generally requires a number of grate attaching fixtures and can require a significant amount of time. In addition, these fixtures for securing a grate to a drainage channel must be secured under a proper tension. Otherwise, the grate can gradually loosen as a variety of compressive forces are repeatedly applied thereto, typically by the passage of vehicles or the like across the grate. In turn, relative motion or rocking can thereafter occur between the grate and the drainage channel.

SUMMARY OF THE INVENTION

According to the present invention, a grate attachment fixture includes a grate securing member having at least two adjustment surfaces which not only attach a grate to a drainage channel, but also provide positive resistance to prevent loosening of the grate relative to the drainage channel. Thus, the grate attachment fixture securely attaches a grate across an upwardly opening trench defined by a longitudinally extending drainage channel.

The drainage channel preferably includes a longitudinally extending bottom wall and first and second longitudinally extending sidewalls which extend upwardly from opposed edges of the bottom wall to thereby define the trench. Each sidewall also preferably defines an engagement surface, such as a locking box which is disposed within a locking box indentation defined within the respective sidewall. In addition, the grate attachment fixture preferably includes a locking bar disposed within the trench and a rotatable connector adapted to adjustably interconnect the locking bar and the grate.

The grate attachment fixture also includes the grate securing member which is affixed to the locking bar. The grate securing member preferably includes at least two adjustment surfaces including a positive engagement surface and a latching surface. The positive engagement surface engages a portion of the connector such that, upon rotation of the connector in a first angular direction, the locking bar initially rotates in the first angular direction until the locking bar engages the sidewalls of the drainage channel and, more preferably, the engagement surfaces defined by the sidewalls. Upon further rotation of the connector in the first angular direction, the positive engagement surface cooperates with the connector so as to apply a tensile force between the grate and the locking bar. Consequently, the grate is attached or secured to the locking bar and, in turn, to the drainage channel.

In addition, the latching surface adjoins the positive engagement surface and is adapted to maintain the connector in a tensioned state with respect to the grate and the locking bar. Thus, the grate attachment fixture, and, in particular, the grate securing member insure that the grate will remain securely attached to the drainage channel.

In a preferred embodiment, the grate securing member is affixed to a first side of the locking bar, opposite the grate. Thus, in this embodiment, the positive engagement surface slopes away from the locking bar in the first angular direction. In contrast, the latching surface of this embodiment slopes toward the locking bar in the first angular direction.

The grate securing member can also include a plurality of adjoining sets of adjustment surfaces such that successively increasing tensile forces can be applied between the grate and the locking bar upon further rotation of the connector in the first angular direction. In another embodiment, the grate securing member can include a pair of oppositely disposed sets of adjustment surfaces oriented such that the grate securing member is radially symmetric about the connecting member. In this embodiment, the connector preferably includes at least one engagement pin and, more preferably, a pair of oppositely extending engagement pins, for engaging the grate securing member. The engagement pins of the connector advance along a respective positive engagement surface and a respective latching surface upon rotation of the connector in the first angular direction.

The grate securing member of this embodiment can also include first and second stop surfaces angularly disposed between the oppositely disposed sets of adjustment surfaces. The first and second stop surfaces engage the engagement pin upon rotation of the connector in a second angular direction, opposite the first angular direction, such that the locking bar can be disengaged from the first and second sidewalls. Accordingly, the grate can be removed from the drainage channel.

In a preferred embodiment, the grate securing member can also include a pair of slits located proximate a respective one of the stop surfaces and adapted to allow passage of a respective engagement pin of the connector therethrough. The grate securing member can also include a ledge disposed between a respective slit and stop surface and adapted to engage an engagement pin of the connector once the locking bar is disengaged from the sidewalls. Thus, the locking bar will remain attached to a connector and will not drop loosely into the trench.

The grate attachment fixture of the present invention therefore provides for both alignment and engagement of the locking bar with the engagement surfaces defined by the opposed sidewalls of the drainage channel and for the application of a tensile force between the grate and the locking bar by simply rotating the connector. In addition, the latching surface of the grate securing member provides positive resistance to any reduction in the tensile force applied between the grate and the locking bar to secure the grate to the drainage channel. By including a plurality of adjoining sets of adjustment surfaces, the tensile force applied between the grate and the locking bar in one embodiment can be successively increased such that the engagement of the grate with the drainage channel can be optimized. In addition, due to the design and structure of the grate attachment fixture of the present invention, a grate can be rapidly installed and removed from a drainage channel, even though the interior of the drainage channel is relatively inaccessible.

DETAILED DESCRIPTION OF THE PREFERRED EMBODIMENTS

Figure 1:
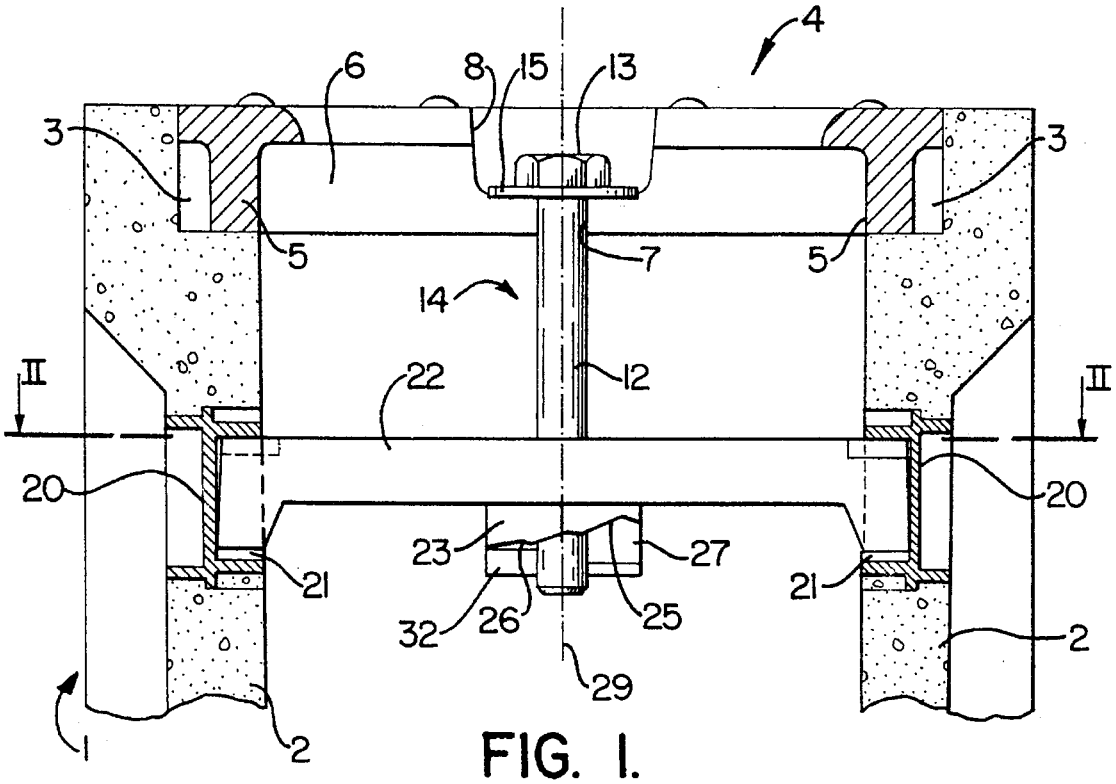
FIG. 1 is a cross-sectional view of a drainage channel including a grate attachment fixture according to one embodiment of the present invention.

Referring now to FIG. 1, a drainage channel 1 is illustrated. The drainage channel includes a longitudinally extending bottom wall and first and second longitudinally extending sidewalls 2. The sidewalls extend upwardly from opposed edges of the bottom wall to thereby define an upwardly opening longitudinal trench. The bottom wall and the first and second sidewalls are generally formed of a relatively rigid material, preferably a cementitious material, such as cement, concrete, or the like, more preferably a polyester concrete as is well known in the art.

As illustrated in FIG. 1, a grate 4 extends laterally across the upwardly opening trench between upper portions of the sidewalls 2 of the drainage channel 1. The grate can be formed of a variety of materials, including metal and plastic materials. The upper portions of the first and second opposed sidewalls include a grate receiving surface. For example, the grate receiving surface can include both horizontal and vertical walls for receiving and aligning the lateral edge portions 5 of the grate which, in the illustrated embodiment, each include a downwardly extending support leg. The grate receiving surface can be integrally formed in the sidewalls in the form of a groove 3 as illustrated in FIG. 1, or can be separate members in the form, e.g., of longitudinally extending frame members, typically comprised of a plastic or metallic material, which can, for example, be mounted in or on the upper edges of the opposed sidewalls.

The grate 4 preferably includes a pair of laterally spaced opposed edge portions 5, e.g., bars or strips, which are received by the grate receiving surface and extend longitudinally therein. The grate also defines a plurality of drainage slots or ports. In a preferred embodiment, the grate includes a number of ribs or cross-bars 6 which extend laterally between the opposed edge portions. While the ribs are generally integrally formed with the opposed edge portions, the ribs can, instead, be attached to the edge portions during the assembly process without departing from the spirit and scope of the present invention. As known to those skilled in the art, the plurality of ribs are generally longitudinally spaced so as to define a plurality of drainage slots, one of which is defined between each pair of adjacent ribs. As will be apparent to those skilled in the art, the grate can, instead, include a generally planar grate surface which defines a plurality of drainage ports or apertures therethrough.

At least two of the ribs 6 preferably include an upwardly opening recessed cavity 8. In order to accommodate the recessed cavity, the respective ribs can include a thickened portion 7, typically in the middle of the rib, in which the recessed cavity is defined. As illustrated in FIG. 1, an aperture 7 is preferably defined through the rib so as to be in fluid communication with the recessed cavity. The aperture is adapted to receive a connector, such as a bolt 14 having a shaft 12 extending through the aperture. A head 13 of the bolt 14 attached to the shaft and disposed within the recessed cavity. A flat or spring washer 15 can also be disposed between the head of the bolt and lower portions of the recessed cavity.

Figure 3:
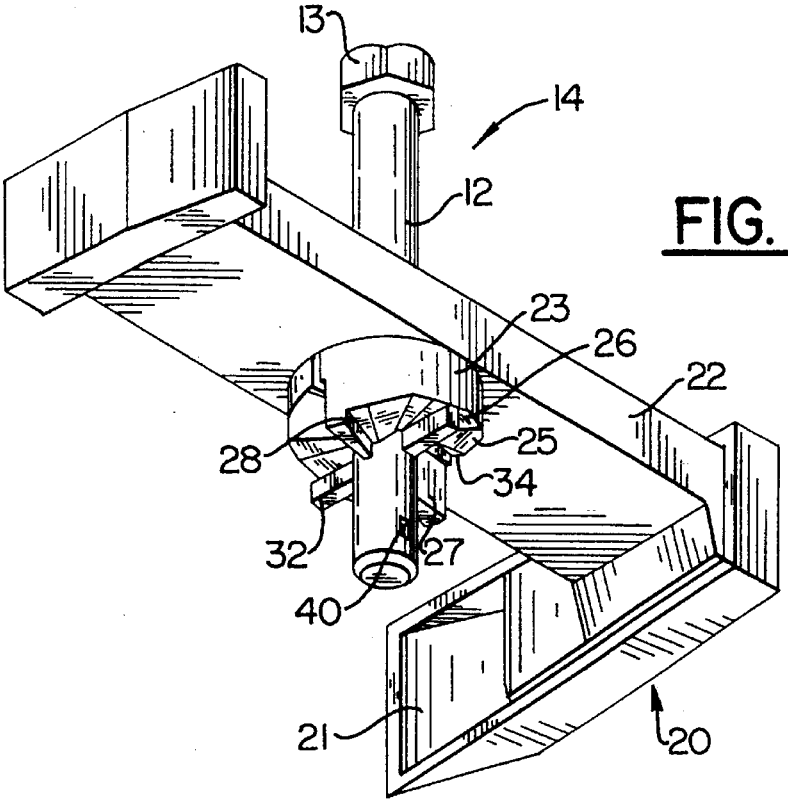
FIG. 3 is a perspective view of the connecting member, locking bar and grate securing member of one embodiment of the present invention.

As also illustrated in FIGS. 1 and 3, the connector can include an engagement pin 32 and, more preferably, a pair of oppositely extending engagement pins which, for example, can extend laterally from lower portions of the bolt 14, opposite the head 13. In one embodiment, the engagement pins have a generally square cross-sectional shape. However, the engagement pins can have a variety of shapes without departing from the spirit and scope of the present invention.

As described in U.S. Pat. No. Re. 33,439, reissued Feb. 25, 1989 to Roland Thomann, et al., the contents of which are incorporated herein by reference, each respective sidewall 2 preferably includes a locking mechanism 20, such as a locking box, inset within a locking box indentation or defined by an interior surface of the sidewall. As described in detail in U.S. Pat. No. Re. 33,439, the locking box is generally comprised of a plastic material and can include one or more inner grooves 21. Since the locking box is comprised of a plastic material, the locking box can absorb a portion of the upwardly directed compressive forces applied to the drainage channel 1 during use so as to protect the drainage channel from deterioration due to these compressive forces.

Figure 2:
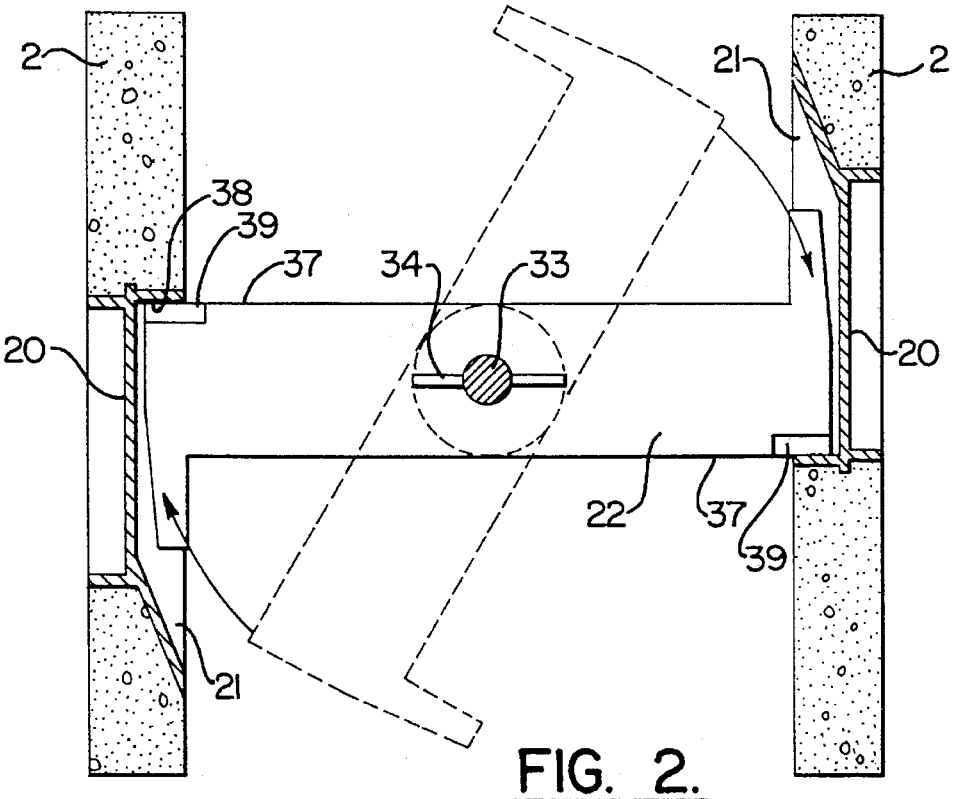
FIG. 2 is cross-sectional view taken along II—II of FIG. 1 and illustrates the rotation and engagement of the locking bar with the first and second locking boxes defined by the opposed sidewalls of the drainage channel.

As illustrated in FIGS. 1–3, a locking bar 22 is also preferably disposed within the trench defined by the drainage channel 1 and is interconnected by the connector, such as the bolt 14, to the grate 4. While the locking bar can be comprised of a variety of materials including cast and rolled metals, the locking bar is preferably comprised of a structural plastic and, more preferably, a reinforced plastic which has been injection molded.

The grate attachment fixture of the present invention also includes a grate securing member affixed to the locking bar 22. In the illustrated embodiment, the grate securing member includes a downwardly extending projection 23 affixed to a lower surface of the locking bar. In addition, the downwardly extending projection can have a generally cylindrical shape. Furthermore, both the locking bar and the grate securing member preferably define an aperture through which the connecting member can be inserted as described below.

Figure 4:
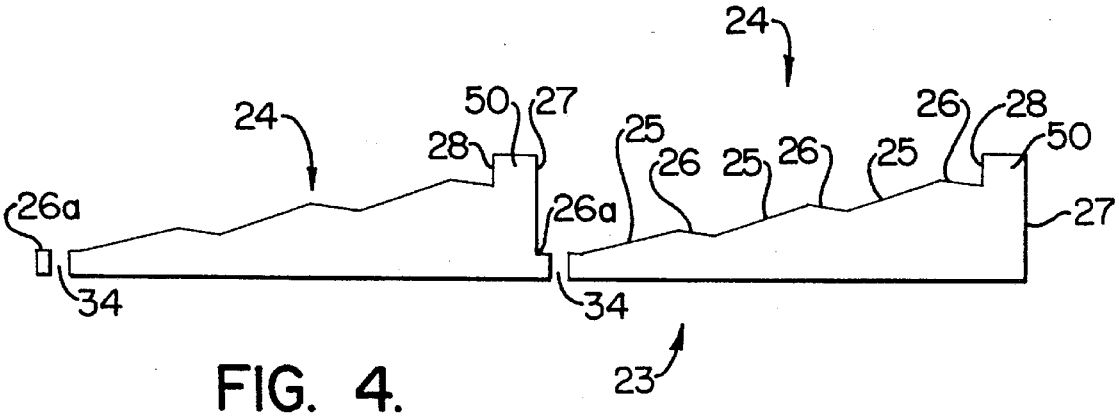
FIG. 4 is a linear representation of the circumferential profile of the downwardly facing adjustment surfaces of the grate securing member illustrated in FIG. 3 which are shown facing upwardly for purposes of illustration.

As illustrated in more detail in FIGS. 3 and 4, the grate securing member includes at least two adjustment surfaces, including a positive engagement surface 25 and a latching surface 26. The positive engagement surface is preferably a circumferentially sloping, i.e., helical, planar surface which is adapted to engage the connector such that, upon rotation of the connector in a first angular direction, the locking bar 22 will be initially rotated within the trench as illustrated in FIG. 2. With continued rotation of the connector in the first angular direction, the locking bar will rotate until the locking bar engages the first and second locking boxes and, in particular, until a front surface of the locking bar contacts the respective stop faces 38 of the locking boxes. In order to facilitate the engagement of the locking bar with the locking boxes, a portion 39 of the top surface 37 of the locking bar can be sloped. Upon further rotation of the connector following engagement of the locking bar 22 with the locking boxes, the positive engagement surface 25 of the grate securing member 23 urges the locking bar in an upward direction. However, since the locking box 20 prevents upward movement of the locking bar, and since the horizontal wall of groove 3 prevents downward movement of the grate, such further rotation causes the connector to apply a tensile force between the grate 4 and the locking bar. In turn, the tensile force between the grate and the locking bar secures the grate to the drainage channel 1.

In the illustrated embodiment in which the grate securing member is a downwardly extending projection 23, the positive engagement surface 25 preferably slopes downwardly in the first angular direction. For purposes of illustration, a linear representation of the circumferential profile of the grate securing member of FIG. 3 is illustrated in FIG. 4. For purposes of illustration, however, the circumferential profile of FIG. 4 has been shown in an upwardly facing direction.

The adjustment surfaces also include a latching surface 26, adjoining the positive engagement surface 25, for also engaging the connector and for providing positive resistance to any reduction in the tensile force applied to the grate 4 and the locking bar 22. Thus, the grate will remain securely attached to the drainage channel 1 even as variety of forces and loads are subsequently applied thereto. As illustrated in FIGS. 3 and 4, the latching surface is also generally a planar surface which has a slope which opposes that of the positive engagement surface. For example, in the illustrated embodiment in which the grate securing member is a downwardly extending projection 23, the latching surface preferably slopes upwardly in the first angular direction.

As also illustrated in FIGS. 3 and 4, the grate securing member preferably includes a plurality of adjoining sets of adjustment surfaces. As described above, each set of adjustment surfaces includes a positive engagement surface 25 and an adjoining latching surface 26. Thus, by continuing to rotate the connector in a first angular direction, the engagement pin 32 of the connector advances along the adjustment surfaces so as to increase the tensile forces applied between the grate 4 and the locking bar 22. Accordingly, the tensile force between the grate and the locking bar can be optimized for a particular application. Once an appropriate tension is established between the grate and the locking bar, the connector can be further rotated so as to seat the engagement pin 32 upon a latching surface, thereby preventing subsequent inadvertent loosening of the grate.

Preferably, the grate securing member includes a pair of oppositely disposed sets 24 of adjustment surfaces which are oriented on the grate securing member in a radially symmetric arrangement about the connector. Advantageously, each of the oppositely disposed sets of adjustment surfaces comprise about 180° of the generally annular grate securing member.

The grate securing member preferably includes first and second stop members 50 disposed angularly between the oppositely disposed sets 24 of adjustment surfaces. The stop members engage the connector and, more particularly, the engagement pin 32 of the connector upon rotation of the connector in the second angular direction, opposite the first direction. The connector is typically rotated in the second angular direction to disengage the locking bar 22 from the first and second locking boxes 20 so that the grate 4 can thereafter be removed from the drainage channel 1. The stop members also serve to prevent excessive tightening of the connector relative to the locking bar which could result in the application of excessive tensile force between the grate and the locking bar. In particular, the stop member prevents additional rotation of the connecting member relative to one locking bar once the connector and, in particular, the engagement pin 32 of the connector contacts a first stop face 28 of the stop member.

In the illustrated embodiment in which the connector includes a pair of oppositely disposed engagement pins 32, the grate securing member preferably defines a pair of slits 34 proximate a respective one of the first and second stop members 50. The slits are adapted to allow passage of the oppositely extending engagement pins 32 of the connector therethrough during insertion of the connector through the apertures defined by the locking bar 22 and the grate securing member. The grate securing member need not include slits. Instead, the engagement pins 32 can be fixedly or disconnectably attached to the connector in a variety of different ways. For example, the pins can be attached following insertion of the connector through the apertures defined by the locking bar and the grate securing member.

In a preferred embodiment, at least one of the grate securing member adjustment surfaces also includes a ledge **26*a* disposed between a respective slit 34 and a stop member 50. The ledge is adapted to engage the respective engagement pin 32 of the connector once the locking bar 22 is disengaged from the first and second locking boxes 20. Thus, the locking bar will remain attached to the connector and will not drop loosely into the drainage channel 1**.

During installation, the connector is initially inserted through the aperture defined in a rib 6 of the grate 4 and the corresponding apertures defined in the locking bar 22 and the grate securing member. In a preferred embodiment, the connector is aligned relative to the locking bar 22 and the grate securing member such that the engagement pins 32 are inserted through the slits 34 defined by the locking bar and the grate securing member. Thereafter, by rotating the connecting member in the first angular direction, such as by turning the head 13 of the bolt 14 clockwise, the locking bar will initially be rotated into engagement with the locking boxes defined by the first and second opposed sidewalls 2. By further rotating the connector in the first angular direction, the engagement pin of 32 the connecting member will advance along the positive engagement surface 25 of the grate securing member, thereby causing the engagement pin 32 to move axially away from the locking bar so as to apply a tensile force between the grate and the locking bar. Upon further rotation of the connector in the first angular direction, the engagement pin 32 will be engaged by and maintained or seated within the latching surface 26 which prevents inadvertent loosening of the tensile forces between the grate and the support pin.

If the installation technician determines that the grate 4 is attached to the drainage channel 1 with sufficient tensile force, rotation of the connecting member is ceased. However, if it is desirable to attach the grate to the drainage channel more securely, e.g., when the grate can still move relative to the sidewalls, the connector can be further rotated in the first angular direction such that the engagement pin 32 of the connecting member advances along another positive engagement surface 25 and is eventually seated upon another latching surface 26.

Preferably, the grate securing member is designed such that only a relatively small angular movement of the connector, such as a quarter to a half turn, is required to attach and disengage the grate 4. In addition, the grate attachment fixture of the present invention provides an efficient manner in which to secure a grate to a drainage channel since rotation of a single component, i.e., the connector, both engages the locking bar 22 with the opposed sidewalls 2, and applies the tensile force between the grate 4 and the locking bar 22.

In order to disengage or loosen the grate 4, the connector is rotated in a second angular direction, opposite the first angular direction, with the result that the engagement pin 32 of the connecting member advances axially downwardly (FIG. 4) along a positive engagement surface 25 so as to move axially toward the locking bar 22, thereby decreasing the tensile forces between the grate and the locking bar 22. Continued rotation of the connector in the second angular direction causes the engagement pin 32 of the connector to eventually contact the second face 27 of a respective stop member 50. Thereafter, further rotation of the connector in the second angular direction will also rotate the locking bar in the second angular direction causing the locking bar to be rotated out of and thus disengaged from the locking boxes 20 defined by the first and second opposed sidewalls. As illustrated and described above, the grate securing member preferably includes a ledge **26*a*** adjacent the stop member for supporting the locking bar once the locking bar has been disengaged from the opposed locking boxes so that the locking bar does not fall loosely within the trench.

In order to facilitate the engagement of the locking bar 22 with locking boxes 20 defined in different relative vertical portions within the opposed sidewalls 2 of various drainage channels 1, the connector can include several openings 40 to which the engagement pins 32 can be connected, such as by inserting the engagement pin 32 through a respective opening sufficiently that the engagement pin 32 extends outwardly from both sides of the connector. The openings are preferably axially spaced along the connector such that the engagement pins 32 can be selectively attached to the opening defined by the connectors which will result in proper alignment of the locking bar with the first and second locking boxes defined in the opposed sidewalls.

What is claimed is:

1. An apparatus for attaching a grate across an upwardly opening drainage channel having opposed sidewalls, the apparatus comprising:

a locking bar adapted to engage the opposed sidewalls of the drainage channel;

an elongate rotatable connector adapted to adjustably interconnect said locking bar and the grate; and a grate securing member affixed to said locking bar, said grate securing member comprising:

at least two sets of adjustment surfaces, each adjustment surface set including a positive engagement surface for engaging a portion said connector such that, upon rotation of said connector in a first angular direction, said locking bar initially rotates in the first angular direction until said locking bar engages the sidewalls of the drainage channel and, upon further rotation of said connector, said adjustment surface sets of said grate securing member cooperate with said connector to apply a tensile force between the grate and said locking bar, and wherein each of said adjustment surface sets further includes a latching surface adjoining the positive engagement surface, said latching surface being adapted to maintain said connector in a tensioned state with respect to the grate and said locking bar such that the grate remains securely attached to the drainage channel;

first and second stop surfaces disposed between said at least two sets of adjustment surfaces for engaging a portion of said connector such that rotation of said connector in a second angular direction, opposite the first angular direction, also rotates said locking bar in the second angular direction to thereby rotationally disengage said locking bar from the first and second longitudinal sidewalls; and first and second ledges disposed adjacent said first and second stop surfaces, respectively, and adapted to engage a portion of said connector once said locking bar is disengaged from the first and second longitudinal sidewalls such that said locking bar remains attached to said connector during any further rotation of said connector in the second angular direction.

2. An apparatus according to claim 1 wherein said grate securing member is affixed to a first side of said locking bar, and wherein the positive engagement surface slopes away from the locking bar in the first angular direction and the latching surface slopes toward the locking bar in the first angular direction.

3. An apparatus according to claim 1 wherein said grate securing means comprises a plurality of adjoining sets of adjustment surfaces such that successively increasing tensile forces can be applied between the grate and said locking bar upon further rotation of said connector in the first angular direction.

4. An apparatus according to claim 1 wherein said connector comprises an engagement pin for engaging said grate securing member and for advancing along at least one positive engagement surface and at least one latching surface upon rotation of said connector in the first angular direction.

5. An apparatus according to claim 1 wherein said grate securing member comprises a pair of oppositely disposed sets of adjustment surfaces oriented such that said grate securing member is radially symmetric about said connector.

6. An apparatus according to claim 5 wherein said connector comprises an engagement pin having a pair of oppositely extending ends for engaging respective ones of said radially symmetric sets of adjustment surfaces.

7. An apparatus according to claim 6 wherein said first and second stop surfaces are disposed angularly between the oppositely disposed sets of adjustment surfaces for engaging a respective engagement pin upon rotation of said connector in a second angular direction, opposite the first angular direction, such that said locking bar disengages from the first and second longitudinal sidewalls.

8. An apparatus according to claim 7 wherein said grate securing member defines first and second slits proximate a respective one of the first and second stop surfaces and adapted to allow passage of the oppositely extending ends of said engagement pin of said connector therethrough.

9. An apparatus according to claim 1 wherein each sidewall defines an engagement surface adapted to receive said locking bar.

10. An apparatus according to claim 9 wherein the engagement surface defined by each sidewall includes a locking box disposed within a locking box indentation defined within the sidewall.

11. A drainage channel comprising:

a longitudinally extending bottom wall;

a first and second longitudinally extending sidewalls extending upwardly from opposed edges of said bottom wall to thereby define an upwardly opening longitudinal trench, said first and second sidewalls defining first and second engagement surfaces, respectively;

a grate received by upper portions of said first and second sidewalls and extending laterally across the upwardly opening trench; and a grate attachment fixture comprising:

a locking bar disposed within the trench defined by the longitudinally extending drainage channel;

a rotatable connector adjustably interconnecting said locking bar and said grate; and a grate securing member affixed to said locking bar, said grate securing member comprising:

at least two sets of adjustment surfaces, each adjustment surface set including a positive engagement surface for engaging a portion of said connector such that, upon rotation of said connector in a first angular direction, said locking bar initially rotates in the first angular direction until said locking bar engages the sidewalls of the drainage channel and, upon further rotation of said connector, said adjustment surface sets of said grate securing member cooperate with said connector to apply a tensile force between said grate and said locking bar, and wherein each of said adjustment surface sets further includes a latching surface adjoining the positive engagement surface, said latching surface being adapted to maintain said connector in a tensioned state with respect to said grate and said locking bar such that said grate remains securely attached to the drainage channel;

first and second stop surfaces disposed between said at least two sets of adjustment surfaces for engaging said connector upon rotation of said connector in a second angular direction, opposite the first angular direction, such that said locking bar is also rotated in the second angular direction to thereby rotationally disengage said locking bar from the first and second longitudinal sidewalls; and first and second ledges disposed adjacent said first and second stop surfaces, respectively, and adapted to engage said connector once said locking bar is disengaged from the first and second longitudinal sidewalls such that said locking bar remains attached to said connector during any further rotation of said connector in the second angular direction.

12. A drainage channel according to claim 11 wherein said grate securing member is affixed to a first side of said locking bar, and wherein the positive engagement surface slopes away from the locking bar in the first angular direction and the latching surface slopes toward the locking bar in the first angular direction.

13. A drainage channel according to claim 11 wherein said grate securing means comprises a plurality of adjoining sets of adjustment surfaces such that successively increasing tensile forces can be applied between said grate and said locking bar upon further rotation of said connector in the first angular direction.

14. A drainage channel according to claim 11 wherein said connector comprises an engagement pin for engaging said grate securing member and for advancing along at least one positive engagement surface and at least one latching surface upon rotation of said connector in the first angular direction.

15. A drainage channel according to claim 11 wherein said grate securing member comprises a pair of oppositely disposed sets of adjustment surfaces oriented such that said grate securing member is radially symmetric about said connector.

16. A drainage channel according to claim 15 wherein said connector comprises an engagement pin having a pair of oppositely extending ends for engaging respective ones of said radially symmetric pair of adjustment surface sets.

17. A drainage channel according to claim 16 wherein said first and second stop surfaces are disposed angularly between the oppositely disposed pairs of adjustment surface sets for engaging said connector upon rotation of said connector in a second angular direction, opposite the first angular direction, such that said locking bar disengages from the first and second longitudinal sidewalls.

18. A drainage channel according to claim 17 wherein said grate securing member defines a pair of slits proximate a respective one of the first and second stop surfaces and adapted to allow passage of the oppositely extending ends of said engagement pin of said connector therethrough.

19. A drainage channel according to claim 11 wherein each of said sidewalls defines an engagement surface adapted to receive said locking bar.

20. A drainage channel according to claim 19 wherein the engagement surface defined by each sidewall includes a locking box disposed within a locking box indentation defined within said sidewall.

* * * * *